US011722828B2

(12) United States Patent
Forrest et al.

(10) Patent No.: US 11,722,828 B2
(45) Date of Patent: Aug. 8, 2023

(54) SUPPORT FOAM FOR PUSH BUTTON IN HEARING DEVICE

(71) Applicant: GN Hearing A/S, Ballerup (DK)

(72) Inventors: Alexander Wildt Forrest, Copenhagen (DK); Laurids Egedal Kirchhoff, Copenhagen (DK); Emil Holm Knudsen, Copenhagen (DK)

(73) Assignee: GN HEARING A/S, Ballerup (DK)

( * ) Notice: Subject to any disclaimer, the term of this patent is extended or adjusted under 35 U.S.C. 154(b) by 63 days.

(21) Appl. No.: 17/529,148

(22) Filed: Nov. 17, 2021

(65) Prior Publication Data

US 2022/0201412 A1 Jun. 23, 2022

(51) Int. Cl.
*H04R 25/00* (2006.01)

(52) U.S. Cl.
CPC ..... *H04R 25/65* (2013.01); *H04R 25/603* (2019.05); *H04R 25/604* (2013.01); *H04R 2225/61* (2013.01)

(58) Field of Classification Search
CPC .. H04R 25/65; H04R 2225/61; H04R 25/603; H04R 25/604
USPC ..... 381/322
See application file for complete search history.

(56) References Cited

U.S. PATENT DOCUMENTS 5,401,920 A 3/1995 Oliveira
5,463,692 A 10/1995 Fackler
2005/0008178 A1 1/2005 Joergensen et al.
2011/0135127 A1 6/2011 Flaig et al.
2012/0163642 A1 6/2012 Dittli et al.
2014/0313688 A1 10/2014 Colahan et al.
2016/0030246 A1 2/2016 Henry et al.
2017/0070801 A1 3/2017 Nguyen et al.

FOREIGN PATENT DOCUMENTS

EP 3367701 8/2018
EP 3823305 5/2021

OTHER PUBLICATIONS

Foreign 1st Examination Report for Danish Patent Appln. No. PA 2020 70857 dated Jun. 11, 2021.
Foreign Intent to Grant for Danish patent application No. PA 2020 70857 dated Dec. 14, 2021.
Foreign Intent to Grant for Danish Patent Appln. No. PA 2020 70857 dated Mar. 30, 2022.
Extended European Search Report for EP Patent Appln. No. 21212182.6 dated May 11, 2022.

*Primary Examiner* — Phylesha Dabney
(74) *Attorney, Agent, or Firm* — Vista IP Law Group, LLP

(57) ABSTRACT

Disclosed is a hearing device comprising a housing. The housing comprises a first input transducer configured to generate one or more input transducer signals based on a received audio signal. The housing comprises a push button for controlling one or more functionalities of the hearing device. The housing comprises a foam element arranged at least partly between the first input transducer and the push button for supporting the push button, wherein the foam element comprises a first foam part being an open-cell foam which is configured for accumulating ear wax and dirt.

15 Claims, 4 Drawing Sheets

Fig. 3a
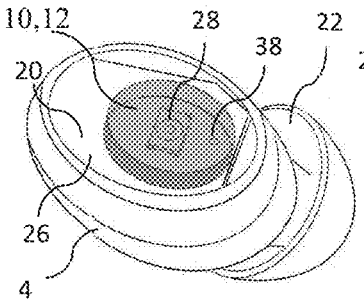
Fig. 3b
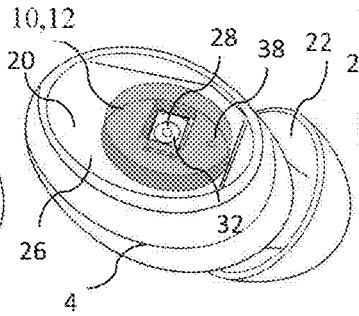
Fig. 3c
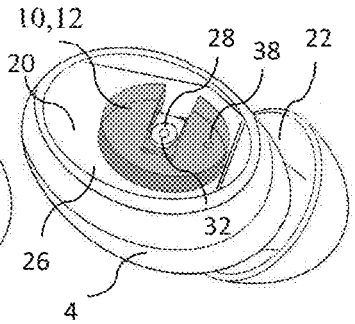
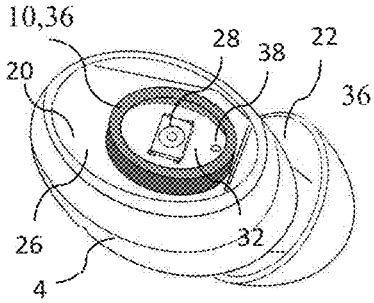
Fig. 3d
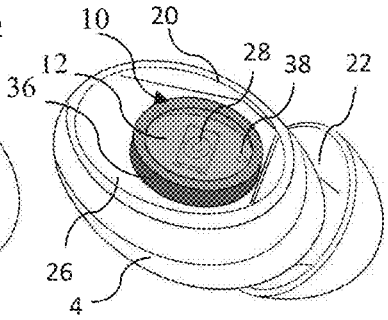
Fig. 3e Fig. 4a
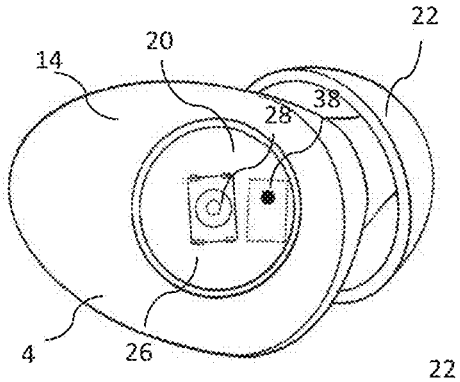
Fig. 4b
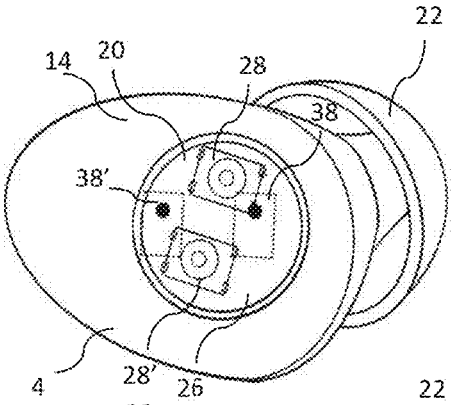
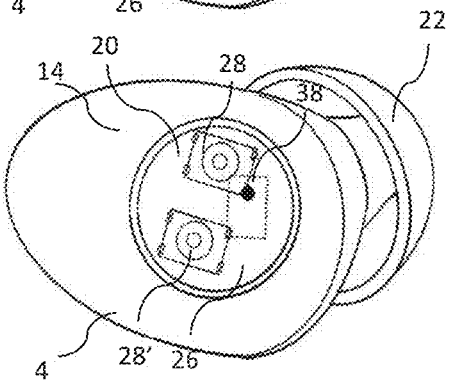
Fig. 4c
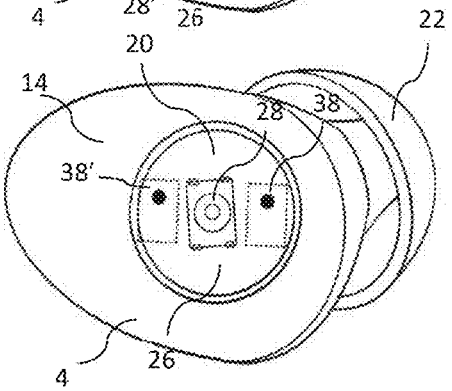
Fig. 4d

SUPPORT FOAM FOR PUSH BUTTON IN HEARING DEVICE

RELATED APPLICATION DATA

This application claims priority to, and the benefit of, Danish Patent Application No. PA 2020 70857 filed on Dec. 21, 2020. The entire disclosure of the above application is expressly incorporated by reference herein.

FIELD

The present disclosure relates to a hearing device comprising a housing. The housing comprises a first input transducer, a push button for controlling one or more functionalities of the hearing device, and a foam element.

BACKGROUND

Hearing devices are used more and more by all kinds of people. Hearing devices may be used for listening to music, having phone calls etc. Hearing devices may be hearing aids used for compensating a hearing loss of the user.

Small and compact wireless hearing devices are gaining popularity as they are easy to bring along in a bag or pocket, comfortable to wear and visually appealing. The hearing devices may comprise a push button for controlling functionalities.

There is a need for an improved support foam for a push button in a hearing device.

SUMMARY

Disclosed is a hearing device comprising a housing. The housing comprises a first input transducer configured to generate one or more input transducer signals based on a received audio signal. The housing comprises a push button for controlling one or more functionalities of the hearing device. The housing comprises a foam element arranged at least partly between the first input transducer and the push button for supporting the push button, wherein the foam element comprises a first foam part being an open-cell foam which is configured for accumulating ear wax and dirt.

It is an advantage that the housing comprises a foam element, which is arranged at least partly between the first input transducer and the push button for supporting the push button.

It is an advantage that the foam element may prevent handling noise in the hearing device when the user pushes or touches the push button.

It is an advantage that the foam element may prevent the push button from rattling.

It is an advantage that the foam element ensures a nice tactile feeling for the user when pushing the push button as the foam element may work like a resilient spring, and the foam element may dampen the "click" sound when the user pushes the button.

The push button is in its designed position, neutral position or starting position, when it is not activated, e.g. by a user. When the push button is pushed by the user, the user can push the push button all the way down to its depressed position. There may be a number of intermediate positions between the designed position and the depressed position.

It is an advantage that the foam element ensures that the push button is maintained in its designed position when the push button is not activated. The foam element may keep the push button pushed outwards when the push button is not pushed down by the user.

The housing comprises the push button. The push button may be arranged on or in the housing. The push button may be flush with the housing when the push button is in its designed position, thus the exterior face of the push button may be aligned with the exterior surface of the housing. The push button may not be flush/aligned with the housing when the push button is in its depressed position.

The housing comprises the foam element. The foam element is arranged at least partly between the first input transducer and the push button. The foam element may be arranged partly or completely between the first input transducer and the push button. If there is more than one input transducer in the housing, the foam element may cover all input transducers, or there may be one foam element for each input transducer.

It is an advantage that the housing comprises a foam element which comprises a first foam part which is an open-cell foam. The first foam part is configured for accumulating ear wax and dirt from the user's ear and the surroundings. It is an advantage that the first foam part is configured for accumulating ear wax and dirt since this may prevent that the input transducer(s) will be clocked/blocked with ear wax and dirt. When the first foam part accumulates the ear wax and dirt, the ear wax and dirt may not move all the way through the housing to reach the input transducer(s). The ear wax and dirt may typically enter into the housing through an air gap/space between the push button and the housing. Thus, it is an advantage that the foam element is arranged at least partly between the push button and the input transducer, since thereby the ear wax and dirt may be accumulated in the first foam part of the foam element before the ear wax and dirt can reach the input transducer(s).

It is an advantage that the foam element is a three-dimensional (3D) structure defined by a length, a width and a height, since the large area/cubic volume of the foam element, such as the first foam part, can accumulate a lot of ear wax and dirt. Ear wax and dirt can be accumulated both on the surface of the foam element and inside the foam element. Thus, it is an advantage that ear wax and other particles, e.g. dirt, can be filtered out to thereby extend the life time of the hearing device, as users are wearing their hearing devices for a longer period, there may be larger openings in the hearing devices, and therefore a structure like the foam element for trapping the ear wax and dirt is an advantageous way to extend the life time of the hearing device.

At least a part of the foam element, such as the entire foam element, is sound transparent. It is an advantage that the foam element is sound transparent, as the foam element will thereby provide a sound path to guide the sound in the housing to the input transducer(s). Even though ear wax and dirt may be accumulated in the foam element, such as in the first foam part, it is assumed that there is still a free sound path in the foam element.

The sound may enter the hearing device housing from the surroundings and reach the first input transducer inside the housing such that the sound can be amplified, attenuated, and/or processed in the hearing device according to the settings. The settings may be defined by the user according to the user's preferences and/or hearing capabilities. If the user has a hearing impairment, the hearing device settings may provide hearing compensation.

The first foam part of the foam element is an open-cell foam. An open-cell foam may be "open"/transparent to sound/air. The open-cell foam may have 50-200 pores, or 50-400 pores, per cubic inch.

The foam element, and e.g. the first foam part, may be made of polyester, plastics etc.

The foam element, and e.g. the first foam part, may be hydrophobic.

The push button is configured to move up and down between the designed position and the depressed position, when pushed by the user.

The movement of the push button may provide that e.g. ear wax is pushed into, or pushed off, or through the foam element, i.e. moving the push button may help remove and/or relocate the ear wax from e.g. one place at the foam element to be distributed all over and/or into the foam element, and/or loosened from the foam element, or through the foam element.

The push button is configured to be activated by a user's finger, e.g. the index finger/forefinger, ring finger, thumb and/or any finger. Thus, the size of the face of the push button which is configured to be activated by the user may have a size which corresponds to or is smaller, or bigger than the user's fingertip, such that the user's finger can activate the push button.

Thus, the push button may be large compared to the hearing device housing, and the face of the push button may e.g. cover the majority of the top surface, e.g. first surface, of the housing. The push button may cover the entire first surface of the housing, or the push button may cover a part, e.g. 25%, 50% or 75%, of the first surface of the housing.

The push button may e.g. be round or oval, and may have a diameter of e.g. 8.5 mm, or 1 cm. The push button may be rectangular, and may have a diagonal distance of e.g. 8.5 mm or 1 cm.

The push button is configured for controlling one or more functionalities of the hearing device. The hearing device may be configured for performing the one for more functionalities.

The functionalities controlled by the push button may e.g. be one or more of:

to power the hearing device on/off;

to answer phone calls;

to activate a digital virtual assistant, which is a software agent that can perform certain tasks based on voice commands;

to control a sound volume up/down;

parring the hearing device with other devices;

to change a sound mode, etc.

The hearing device may be associated, such as paired, e.g. by Bluetooth, with an external electronic device, such as a smartphone. Some or all of the functionalities controlled by the push button may alternatively and/or additionally be controlled via the associated external electronic device, e.g. via a software application installed on the associated external electronic device.

The housing of the hearing device may be an at least partly closed entity comprising one or more electronic components of the hearing device. The housing may comprise an exterior surface, which may be in contact with the user's skin. The housing may comprise an interior space where the electronic components are arranged.

The housing is configured to be arranged at the ear of the user in an intended operational position. The housing may be arranged at the outer ear. The housing may be arranged at the concha, in the ear canal, and/or partly in the ear canal. The housing may be arranged behind the ear. The housing may be shaped like an earbud.

The housing comprises a first input transducer configured to generate one or more input transducer signals based on a received audio signal. The first input transducer may be an electronic component of the hearing device. The received audio signal may be audio from the surroundings of the user. The first input transducer generates input transducer signals. The hearing device may comprise other input transducers, such as a second input transducer, a third input transducer, a fourth input transducer etc. The other input transducers may be arranged in the interior space/cavity of the housing like the first input transducer.

The other input transducers may be arranged on the exterior surface of the housing. The other input transducers may e.g. be directional microphones for providing beamforming of the received sound. Input transducers arranged on the exterior surface of the housing may be used to pick up sound, such as "own voice pickup", i.e. the user's own voice, for calls and commands. If the hearing device is used as a hearing aid, then in a hearing mode, input transducers arranged on the exterior surface of the housing can be used for amplifying the surrounding sound, and the actual amplification which is programed is based on the user's hearing loss. For example, two input transducers arranged on the exterior surface of the housing may be provided. These two exterior input transducers may be used to create a directional sound input, which may provide a wider or more narrow sound pick up.

The input transducer signals may be provided to a signal processing unit, e.g. on a printed circuit board. The signal processing unit may process the input transducer signals and provide an output signal.

The housing may comprise an output transducer, such as a receiver or speaker. The output transducer may be an electronic component of the hearing device. The output signal from the signal processing unit may be provided to the output transducer. A dome may be attached to the housing for providing the sound in the ear canal of the user, and/or the output transducer may be arranged outside the housing.

The hearing device may be a headset, a hearing aid, a hearable etc. The hearing device may be an in-the-ear (ITE) hearing device, a receiver-in-ear (RIE) hearing device, a receiver-in-canal (RIC) hearing device, a microphone-and-receiver-in-ear (MaRIE) hearing device, a behind-the-ear (BTE) hearing device, an over-the-counter (OTC) hearing device etc, a one-size-fits-all hearing device etc.

The hearing device is configured to be worn by a user. The hearing device may be arranged at the user's ear, on the user's ear, in the user's ear, in the user's ear canal, behind the user's ear etc. The user may wear two hearing devices, one hearing device at each ear. The two hearing devices may be connected, such as wirelessly connected.

The hearing device may be configured for audio communication, e.g. enabling the user to listen to media, such as music or radio, and/or enabling the user to perform phone calls. The hearing device may be configured for performing hearing compensation for the user. The hearing device may be configured for performing noise cancellation etc.

The hearing device comprises a first input transducer, e.g. a microphone, to generate one or more microphone output signals based on a received audio signal. The audio signal may be an analogue signal. The microphone output signal may be a digital signal. Thus, the first input transducer, e.g. microphone, or an analogue-to-digital converter, may convert the analogue audio signal into a digital microphone output signal. All the signals may be sound signals or signals comprising information about sound. The hearing device may comprise a signal processor. The one or more microphone output signals may be provided to the signal processor for processing the one or more microphone output signals. The signals may be processed such as to compensate for a user's hearing loss or hearing impairment. The signal processor may provide a modified signal. All these components may be comprised in a housing of an ITE unit or a BTE unit. The hearing device may comprise a receiver or output transducer or speaker or loudspeaker. The receiver may be connected to an output of the signal processor. The receiver may output the modified signal into the user's ear. The receiver, or a digital-to-analogue converter, may convert the modified signal, which is a digital signal, from the processor to an analogue signal. The receiver may be comprised in an ITE unit or in an earpiece, e.g. RIE unit or MaRIE unit. The hearing device may comprise more than one microphone, and the ITE unit or BTE unit may comprise at least one microphone and the RIE unit may also comprise at least one microphone.

The hearing device signal processor may comprise elements such as an amplifier, a compressor and/or a noise reduction system etc. The signal processor may be implemented in a signal-processing chip or a printed circuit board (PCB). The hearing device may further have a filter function, such as compensation filter for optimizing the output signal.

The hearing device may furthermore comprise a wireless communication unit or chip, such as a wireless communication circuit or a magnetic induction chip, for wireless data communication interconnected with an antenna, such as an radio frequency (RF) antenna or a magnetic induction antenna, for emission and reception of an electromagnetic field. The wireless communication unit including a radio or a transceiver, may connect to the hearing device signal processor and the antenna, for communicating with one or more external devices, such as one or more external electronic devices, including at least one smart phone, at least one tablet, at least one hearing accessory device, including at least one spouse microphone, remote control, audio testing device, etc., or, in some embodiments, with another hearing device, such as another hearing device located at another ear, typically in a binaural hearing device system.

The hearing device may be any hearing device, such as any hearing device compensating a hearing loss of a wearer of the hearing device, or such as any hearing device providing sound to a wearer, or such as a hearing device providing noise cancellation, or such as a hearing device providing tinnitus reduction/masking. The person skilled in the art is well aware of different kinds of hearing devices and of different options for arranging the hearing device in and/or at the ear of the hearing device wearer.

For example, the hearing device may be an In-The-Ear (ITE), Receiver-In-Canal (RIC) or Receiver-In-the-Ear (RIE or RITE) or a Microphone-and-Receiver-In-the-Ear (MaRIE) type hearing device, in which a receiver is positioned in the ear, such as in the ear canal, of a wearer during use, for example as part of an in-the-ear unit, while other hearing device components, such as a processor, a wireless communication unit, a battery, etc. are provided as an assembly and mounted in a housing of a Behind-The-Ear (BTE) unit. A plug and socket connector may connect the BTE unit and the earpiece, e.g. RIE unit or MaRIE unit.

The hearing device may comprise a RIE unit. The RIE unit typically comprises the earpiece such as a housing, a plug connector, and an electrical wire/tube connecting the plug connector and earpiece. The earpiece may comprise an in-the-ear housing, a receiver, such as a receiver configured for being provided in an ear of a user and/or a receiver being configured for being provided in an ear canal of a user, and an open or closed dome. The dome may support correct placement of the earpiece in the ear of the user. The RIE unit may comprise a microphone, a receiver, one or more sensors, and/or other electronics. Some electronic components may be placed in the earpiece, while other electronic components may be placed in the plug connector. The receiver may be with a different strength, i.e. low power, medium power, or high power. The electrical wire/tube provides an electrical connection between electronic components provided in the earpiece of the RIE unit and electronic components provided in the BTE unit. The electrical wire/tube as well as the RIE unit itself may have different lengths.

In some embodiments, the push button is provided on a first surface of the housing, the first surface pointing towards the surroundings when the hearing device is arranged at the user's ear in its intended position. The first surface may be on the exterior of the housing. It is an advantage that the push button is on the surface of the housing pointing towards the surroundings, as this provides free access to the push button allowing the user to activate the push button when desired. Furthermore, it is an advantage that the push button is on the surface of the housing pointing towards the surroundings, if one or more other input transducers, i.e. other than the first input transducer, are arranged at the exterior face of the push button, since this may provide improved capture of incoming sound at the other input transducers.

In some embodiments, an air gap is provided between the push button and the housing in the first surface of the housing. The air gap is at least partly defined by an opening in the housing, where the push button is arranged. The air gap may have a shape which at least partly corresponds to the shape of the push button. The air gap may have a shape which corresponds to the shape of the push button. For example, the push button may be circular, and the air gap may be ring-shaped, e.g. around the shape of the push button. The air gap may have a shape which does not correspond to the shape of the push button. For example, the push button may be circular, but the air gap may not be ring-shaped, but e.g. oval.

The air gap at least partly provides the sound path from the outside surroundings to the first input transducer in the housing. Alternatively and/or additionally, there may be one or more small through hole(s) in the push button for providing sound path(s), which could improve the sound entry into the housing.

In some embodiments, the housing comprises a printed circuit board (PCB), and an electrical contact is arranged on the printed circuit board for providing an electrical connection to the push button for controlling the one or more functionalities of the hearing device. The electrical contact is arranged on the printed circuit board for providing the electrical connection to the push button for controlling the one or more functionalities of the hearing device, when the push button is activated by pushing it down into its depressed position. A protrusion on the push button may be provided to touch the electrical contact. As an alternative to an electrical contact on the printed circuit board, a "free" switch may be connected to the printed circuit board by electrical wires.

The push button may be suspended in different ways. It can be guided along a linear path. However, it can also be arranged to swivel about a pivot, parallel with the PCB.

In some embodiments, the foam element at least partly encases/encloses/surrounds the electrical contact.

In some embodiments, the housing comprises an opening in the first surface, and the push button is provided in the opening. The opening may be a hole, a hollow, an indentation, a groove, a recess, a depression and/or the like.

In some embodiments, the foam element extends throughout the entire opening in the first surface. In this case, the electrical contact or switch pushes on the foam, which is between the printed circuit board and the bottom face, such as a second face, of the push button.

In some embodiments, the foam element comprises a cut-out in the foam element for the electrical contact. In this case, the electrical contact or switch is at the cut-out in the foam element. The cut-out in the foam element may be in a centre of the foam element, and/or in an edge of the foam element.

In some embodiments, the foam element comprises a cut-out in the foam element for other components than the electrical contact.

In some embodiments, the foam element has a thickness, and the thickness is uniform throughout the foam element. The thickness may be e.g. 0.5 mm. The foam element may be compressed at the position of the electrical contact. The foam element may be compressed at the position of other components.

In some embodiments, the foam element has a thickness, and the thickness is smaller at the electrical contact than in the remaining foam element. The thickness may be e.g. 0.5 mm except at the position of the electrical contact, where the foam element may have a thickness of e.g. 0.2 mm. The foam element may be compressed at the position of the electrical contact.

In some embodiments, the foam element further comprises a second foam part, and the second foam part is provided along the edge of the foam element, and the first foam part is provided in a centre of the foam element.

Alternatively, if there is only the first foam part, then the first foam part is both provided along the edge and in the centre of the foam element.

In some embodiments, the foam element further comprises a second foam part, and the second foam part is provided along a second part of the edge of the foam element and in a second part of the centre of the foam element, and the first foam part is provided along a first part of the edge of the foam element and in a first part of the centre of the foam element.

In some embodiments, the second foam part is a closed-cell foam. A closed-cell foam may be "closed"/non-transparent to sound/air. A closed-cell foam may not accumulate as much ear wax and dirt as an open-celled foam.

It is an advantage that when the second foam part is a closed-cell foam and is arranged along the edge of the foam element, then sound coming into the hearing device from other directions than the air gap between the push button and the housing, can be blocked by the second foam part. Thereby it may only be the sound coming through the air gap which will enter the input transducer through the first foam part.

In some embodiments, the second foam part is a foam having a different, such as higher, density and/or a different, such as a smaller, pore size than the first foam part. The second foam part may less open-celled and less transparent to sound/air than the first foam part. The second foam part may not accumulate as much ear wax and dirt as first foam part.

In some embodiments, the push button comprises:

a first face being aligned with the first surface of the housing, and thereby pointing towards the surroundings when the hearing device is arranged at the user's ear in its intended position;

a second face pointing downwards towards an interior cavity/space of the housing;

a third face being a circumference/perimeter of the push button and defining a height of the push button, the third face connecting the first face and second face.

In some embodiments, the air gap is provided at the third face of the push button. The air gap is provided at the third face of the push button and the first surface of the housing.

In some embodiments, the first input transducer is provided on the printed circuit board. The first input transducer may be a surface-mounted device (SMD). The first input transducer may be mounted on the side of the printed circuit board pointing towards the interior space/cavity of the housing. A hole, such as a through-hole, may be provided in the printed circuit board for providing a sound path to the first input transducer arranged on the other side of the printed circuit board.

Alternatively, the first input transducer may be mounted or the other side of the printed circuit board pointing towards the push button.

In some embodiments, the first input transducer is provided in the foam element. If the first input transducer is not provided on the printed circuit board, it may be embedded in the foam element, such as free-floating in the foam element.

In some embodiments, the first input transducer has a transducer opening, and a physical filter is arranged at the transducer opening, the physical filter providing an acoustic filtering of the received audio signal. The physical filter may e.g. be a HD15 filter. The physical filter may protect the first input transducer against moist, as the physical filter may be hydrophobic. The physical filter may provide acoustic resistance.

In some embodiments, the push button and/or the foam element is/are configured to be detached from the housing of the hearing device and be replaced with a new corresponding push button and/or foam element. Thus, if the push button and/or foam element is/are broken, the push button and/or foam element can be detached, separated, disassembled from the housing, and a new corresponding push button and/or foam element can be mounted in the opening in the housing. Thus, either the push button can be replaced, or the foam element can be replaced, or both the push button and the foam element can be replaced.

The present invention relates to different aspects including the hearing device described above and in the following, and corresponding devices, systems, kits, uses and/or product means, each yielding one or more of the benefits and advantages described in connection with the first mentioned aspect, and each having one or more embodiments corresponding to the embodiments described in connection with the first mentioned aspect and/or disclosed in the appended claims.

BRIEF DESCRIPTION OF THE DRAWINGS

The above and other features and advantages will become readily apparent to those skilled in the art by the following detailed description of exemplary embodiments thereof with reference to the attached drawings, in which:

FIGS. 3*a*), 3*b*), 3*c*), 3*d*), and 3*e*) schematically illustrates an example of a hearing device comprising a housing and different variations of a foam element.

FIGS. 4*a*), 4*b*), 4*c*), and 4*d*) schematically illustrates an example of a hearing device comprising a housing and different variations of electrical contacts.

DETAILED DESCRIPTION

Figure 1:
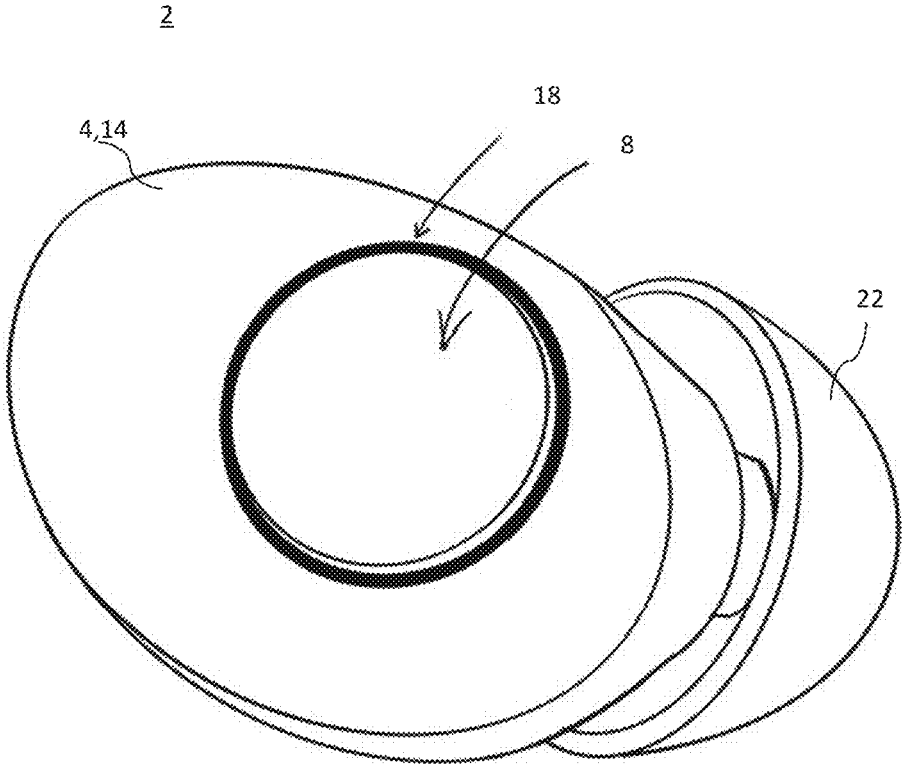
FIG. 1 schematically illustrates an example of a hearing device 2 comprising a housing 4 and a push button.

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Throughout, the same reference numerals are used for identical or corresponding parts.

FIG. 1 schematically illustrates an example of a hearing device 2 comprising a housing 4 and a push button 8.

FIG. 1 schematically illustrates an example of a hearing device 2 comprising a housing 4. The housing 4 comprises a first input transducer (not shown) configured to generate one or more input transducer signals based on a received audio signal. The housing 4 comprises a push button 8 for controlling one or more functionalities of the hearing device 2. The housing 4 comprises a foam element (not shown) arranged at least partly between the first input transducer and the push button 8 for supporting the push button 8. The foam element comprises a first foam part (not shown) being an open-cell foam, which is configured for accumulating ear wax and dirt.

The push button 8 is shown in its designed position, neutral position or starting position, which is the position when the push button 8 is not activated, e.g. by a user. When the push button is pushed by the user, the user can push the push button all the way down to its depressed position.

The push button 8 is arranged on or in the housing 4. The push button 8 is shown to be flush with the housing 4 when the push button 4 is in its designed position, thus the exterior face of the push button 8 is aligned with the exterior surface of the housing 4. The push button 8 may not be flush/aligned with the housing 4 when the push button 8 is in its depressed position.

The push button 8 may be large compared to the hearing device housing 4, and the face of the push button 8 may cover the majority of the top surface, e.g. first surface 14, of the housing 4. The push button may cover a part, e.g. 25%, 50% or 75%, of the first surface 14 of the housing 4.

The push button 8 may be round or oval, and may have a diameter of e.g. 1 cm.

The push button 8 is provided on a first surface 14 of the housing 4. The first surface 14 is configured to point towards the surroundings when the hearing device 2 is arranged at the user's ear in its intended position. The first surface 14 is on the exterior 16 of the housing 4.

An air gap 18 is provided between the push button 8 and the housing 4 in the first surface 14 of the housing 4. The air gap 18 is at least partly defined by an opening in the housing 4, where the push button 8 is arranged. The air gap 18 has a shape which at least partly corresponds to the shape of the push button 8. The push button 8 is circular, and the air gap 18 is ring-shaped, e.g. around the shape of the push button 8.

A dome 22 may be attached to the housing 4 for providing the sound in the ear canal of the user. A dome may not be provided if the hearing device is e.g. a BTE and RIE device.

Figure 2A:
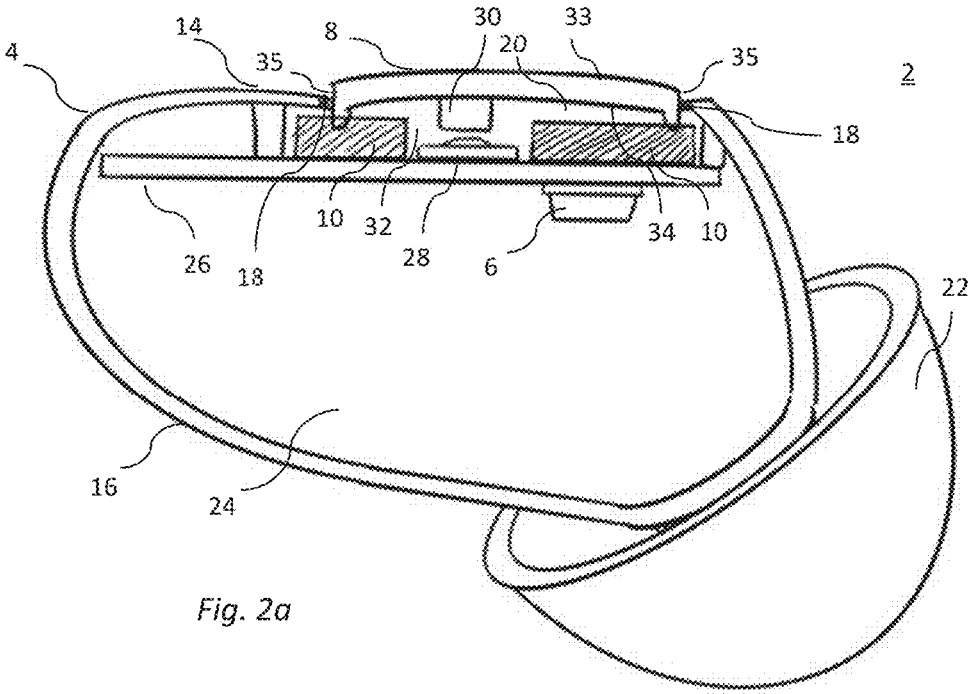
FIGS. 2*a*) and 2*b*) schematically illustrates a cross-section of an example of a hearing device comprising a housing, a push button and a foam element.

FIGS. 2*a*) and 2*b*) schematically illustrates a cross-section of an example of a hearing device 2 comprising a housing 4, a push button 8 and a foam element 10.

FIGS. 2*a*) and 2*b*) schematically illustrates an example of a cross-section of a hearing device 2 comprising a housing 4. The housing 4 comprises a first input transducer 6 configured to generate one or more input transducer signals based on a received audio signal. The housing 4 comprises a push button 8 for controlling one or more functionalities of the hearing device 2. The housing 4 comprises a foam element 10 arranged at least partly between the first input transducer 6 and the push button 8 for supporting the push button 8. The foam element 10 comprises a first foam part being an open-cell foam, which is configured for accumulating ear wax and dirt.

The housing 4 of the hearing device 2 is an at least partly closed entity comprising one or more electronic components of the hearing device 2. The housing 4 comprises an exterior surface 16, which may be in contact with the user's skin. The housing 4 comprise an interior space 24 where the electronic components are arranged.

The housing 4 comprises a printed circuit board (PCB) 26, and an electrical contact 28 is arranged on the printed circuit board 26 for providing an electrical connection to the push button 8 for controlling the one or more functionalities of the hearing device 2. The electrical contact 28 is arranged on the printed circuit board 26 for providing the electrical connection to the push button 8 for controlling the one or more functionalities of the hearing device 2, when the push button 8 is activated by pushing it down into its depressed position. A protrusion 30 on the push button 8 is provided to touch the electrical contact 28.

The first input transducer 6 may be a surface-mounted device (SMD). The first input transducer 6 is mounted on the side of the printed circuit board 26 pointing towards the interior space/cavity 24 of the housing 4. A hole (not shown), such as a through-hole, may be provided in the printed circuit board 26 for providing a sound path to the first input transducer 6 arranged on the other side of the printed circuit board 26.

Figure 2B:
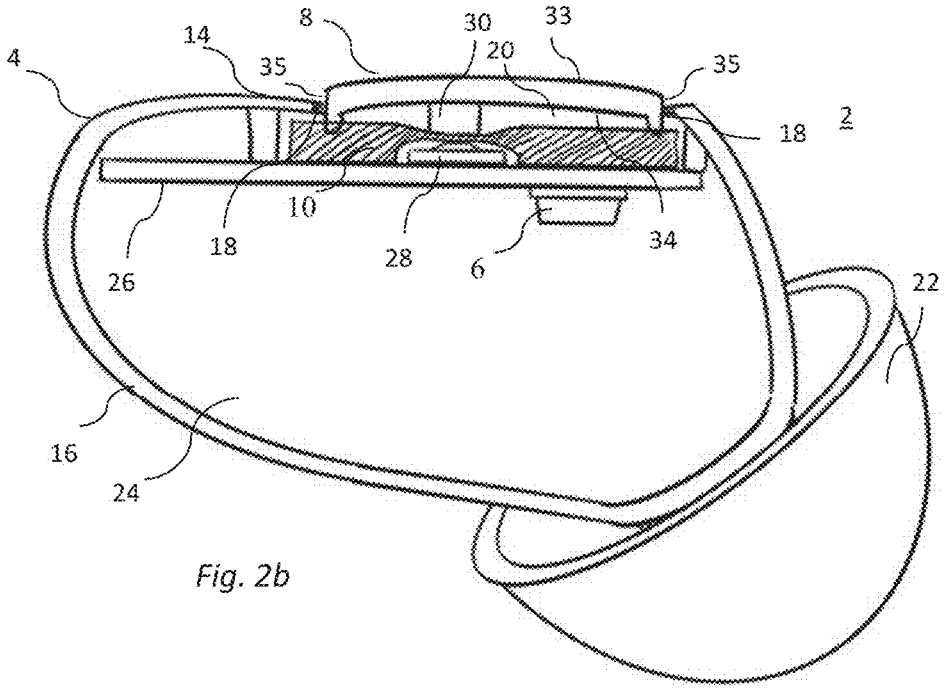

The foam element 10 at least partly encases/encloses/surrounds the electrical contact 28. In FIG. 2*a*), the foam element 10 partly encases/encloses/surrounds the electrical contact 28. In FIG. 2*b*), the foam element 10 completely encases/encloses/surrounds the electrical contact 28.

The housing 4 comprises an opening 20 in the first surface 14, and the push button 8 is provided in the opening 20. The opening 20 may be a hole, a hollow, an indentation, a groove, a recess, a depression and/or the like.

The push button 8 comprises a first face 33 being aligned with the first surface 14 of the housing 4, and thereby pointing towards the surroundings when the hearing device 2 is arranged at the user's ear in its intended position. The push button 8 comprises a second face 34 pointing downwards towards the interior cavity/space 24 of the housing 4. The push button 8 comprises a third face 35 being a circumference/perimeter of the push button 8 and defining a height of the push button 8, the third face 35 connecting the first face 34 and second face 35.

In FIG. 2*a*), the foam element 10 comprises a cut-out 32 in the foam element 10 for the electrical contact 28. In this case, the electrical contact 28 is at the cut-out 32 in the foam element 10. The cut-out 32 in the foam element 10 is in a centre of the foam element 10.

In FIG. 2*b*), the foam element 10 extends throughout the entire opening 20 in the first surface 14. In this case, the electrical contact 28 pushes on the foam element 10, which is between the printed circuit board 26 and the bottom face, such as a second face 34, of the push button 8.

In FIG. 2*a*), the foam element 10 has a thickness which is uniform throughout the foam element 10.

In FIG. 2*b*), the foam element 10 has a thickness which is smaller at the electrical contact 28 than in the remaining foam element 10. Alternatively, and/or additionally, the foam element 10 is compressed at the position of the electrical contact 28.

A dome 22 may be attached to the housing 4 for providing the sound in the ear canal of the user. A dome may not be provided if the hearing device is e.g. a BTE and RIE device.

FIGS. 3*a*), 3*b*), 3*c*), 3*d*), and 3*e*) schematically illustrates an example of a hearing device 2 comprising a housing 4 and different variations of a foam element 10.

FIGS. 3*a*), 3*b*), 3*c*), 3*d*) and 3*e*) schematically illustrates an example of a hearing device 2 comprising a housing 4. The housing 4 comprises a first input transducer (not shown) configured to generate one or more input transducer signals based on a received audio signal. The housing 4 comprises a push button (not shown) for controlling one or more functionalities of the hearing device 2.

In FIGS. 3*a*), 3*b*), 3*c*), 3*d*) and 3*e*) the push button is not shown, instead the hearing device 2 is shown without the push button, such that the housing 4 and the foam element 10 below the push button is visible.

The housing 4 comprises a foam element 10 arranged at least partly between the first input transducer and the push button for supporting the push button. The foam element 10 comprises a first foam part 12 being an open-cell foam, which is configured for accumulating ear wax and dirt.

The housing 4 comprises a printed circuit board (PCB) 26, and an electrical contact 28 is arranged on the printed circuit board 26 for providing an electrical connection to the push button for controlling the one or more functionalities of the hearing device 2, when the push button is activated by pushing it down into its depressed position.

The hole 38 in the printed circuit board 26 is a through-hole for the first input transducer (not shown) which may be arranged on the other side of the printed circuit board 26.

The foam element 10 at least partly encases/encloses/surrounds the electrical contact 28. In FIGS. 3*a*) and 3*e*), the foam element 10 completely encases/encloses/surrounds the electrical contact 28. In FIGS. 3*b*), 3*c*) and 3*d*), the foam element 10 partly encases/encloses/surrounds the electrical contact 28.

The housing 4 comprises an opening 20 in the first surface 14, and the push button is provided in the opening 20. The opening 20 may be a hole, a hollow, an indentation, a groove, a recess, a depression and/or the like.

In FIGS. 3*a*) and 3*e*), the foam element 10 extends throughout the entire opening 20 in the first surface 14. In this case, the electrical contact 28 pushes on the foam element 10, which is between the printed circuit board 26 and the bottom face, such as a second face, of the push button.

In FIGS. 3*b*), 3*c*) and 3*d*), the foam element 10 comprises a cut-out 32 in the foam element 10 for the electrical contact 28. In this case, the electrical contact 28 is at the cut-out 32 in the foam element 10. The cut-out 32 in the foam element 10 is in a centre of the foam element 10.

In FIGS. 3*d*) and 3*e*), the foam element 10 comprises a second foam part 36, and the second foam part 36 is provided along the edge of the foam element 10. In FIG. 3*e*) the first foam 12 part is provided in a centre of the foam element 10 and surrounded by the second foam part 36.

The second foam part is a closed-cell foam. A closed-cell foam may be "closed"/non-transparent to sound/air. A closed-cell foam may not accumulate as much ear wax and dirt as an open-celled foam. When the second foam part 36 is a closed-cell foam and is arranged along the edge of the foam element 10, then sound coming into the hearing device 2 from other directions than the air gap between the push button and the housing, can be blocked by the second foam part. Thereby it may only be the sound coming through the air gap which will enter the input transducer through the first foam part 12.

In FIGS. 3*a*), 3*b*) and 3*c*), only the first foam part 12 is present, then the first foam part 12 is both provided along the edge and in the centre of the foam element 10.

A dome 22 may be attached to the housing 4 for providing the sound in the ear canal of the user. A dome may not be provided if the hearing device is e.g. a BTE and RIE device.

Any combination of the features shown in FIGS. 3*a*), 3*b*), 3*c*), 3*d*) and 3*e*) may be used.

FIGS. 4*a*), 4*b*), 4*c*), and 4*d*) schematically illustrates an example of a hearing device comprising a housing and different variations of electrical contacts.

FIGS. 4*a*), 4*b*), 4*c*), and 4*d*) schematically illustrates an example of a hearing device 2 comprising a housing 4. The housing 4 comprises a first input transducer (not shown) configured to generate one or more input transducer signals based on a received audio signal. The housing 4 comprises a push button (not shown) for controlling one or more functionalities of the hearing device 2.

In FIGS. 4*a*), 4*b*), 4*c*), and 4*d*) the push button and the foam element are not shown, instead the hearing device 2 is shown without the push button and the foam element, such that the housing 4 below the push button is visible.

The housing 4 comprises a foam element (not shown) arranged at least partly between the first input transducer and the push button for supporting the push button. The foam element comprises a first foam part (not shown) being an open-cell foam, which is configured for accumulating ear wax and dirt.

The housing 4 comprises an opening 20 in the first surface 14, and the push button is provided in the opening 20. The opening 20 may be a hole, a hollow, an indentation, a groove, a recess, a depression and/or the like.

FIGS. 4*a*), 4*b*), 4*c*) and 4*d*) show the housing 4 comprising a printed circuit board (PCB) 26, and an electrical contact 28 is arranged on the printed circuit board 26 for providing an electrical connection to the push button for controlling the one or more functionalities of the hearing device 2, when the push button is activated by pushing it down into its depressed position.

FIGS. 4*b*) and 4*c*) show an extra electrical contact 28' arranged on the printed circuit board 26 for providing an extra electrical connection to the push button for controlling the one or more functionalities of the hearing device 2, when the push button is activated by pushing it down into its depressed position.

In FIGS. 4*a*), 4*b*), 4*c*) and 4*d*), the hole 38 in the printed circuit board 26 is a through-hole for the first input transducer (not shown) which may be arranged on the other side of the printed circuit board 26.

FIGS. 4*b*) and 4*d*) show an extra hole 38' in the printed circuit board 26 which is a through-hole for another input transducer (not shown) which may be arranged on the other side of the printed circuit board 26.

A dome 22 may be attached to the housing 4 for providing the sound in the ear canal of the user. A dome may not be provided if the hearing device is e.g. a BTE and RIE device.

Any combination of the features shown in FIGS. 4*a*), 4*b*), 4*c*), and 4*d*) may be used.

The push button may be suspended in different ways. It can be guided along a linear path. However, it can also be arranged to swivel about a pivot, parallel with the PCB.

Although particular features have been shown and described, it will be understood that they are not intended to limit the claimed invention, and it will be made obvious to those skilled in the art that various changes and modifications may be made without departing from the scope of the claimed invention. The specification and drawings are, accordingly to be regarded in an illustrative rather than restrictive sense. The claimed invention is intended to cover all alternatives, modifications and equivalents.

Items:

1. A hearing device comprising a housing, wherein the housing comprises:

a first input transducer configured to generate one or more input transducer signals based on a received audio signal;

a push button for controlling one or more functionalities of the hearing device;

a foam element arranged at least partly between the first input transducer and the push button for supporting the push button, wherein the foam element comprises a first foam part being an open-cell foam which is configured for accumulating ear wax and dirt.

2. The hearing device according to any of the preceding items, wherein the push button is provided on a first surface of the housing, the first surface pointing towards the surroundings when the hearing device is arranged at the user's ear in its intended position.

3. The hearing device according to any of the preceding items, wherein an air gap is provided between the push button and the housing in the first surface of the housing.

4. The hearing device according to any of the preceding items, wherein the housing comprises a printed circuit board (PCB), and wherein an electrical contact is arranged on the printed circuit board for providing an electrical connection to the push button for controlling the one or more functionalities of the hearing device.

5. The hearing device according to any of the preceding items, wherein the foam element at least partly encases/encloses/surrounds the electrical contact.

6. The hearing device according to any of the preceding items, wherein the housing comprises an opening in the first surface, and wherein the push button is provided in the opening.

7. The hearing device according to any of the preceding items, wherein the foam element extends throughout the entire opening in the first surface, and/or wherein the foam element comprises a cut-out in the foam element for the electrical contact.

8. The hearing device according to any of the preceding items, wherein the foam element has a thickness, wherein the thickness is uniform throughout the foam element, or wherein the thickness is smaller at the electrical contact than in the remaining foam element.

9. The hearing device according to any of the preceding items, wherein the foam element further comprises a second foam part, wherein the second foam part is provided along the edge of the foam element, and wherein the first foam part is provided in a centre of the foam element.

10. The hearing device according to any of the preceding items, wherein the second foam part is a closed-cell foam.

11. The hearing device according to any of the preceding items, wherein the push button comprises:

a first face being aligned with the first surface of the housing, and thereby pointing towards the surroundings when the hearing device is arranged at the user's ear in its intended position;

a second face pointing downwards towards an interior cavity/space of the housing;

a third face being a circumference/perimeter of the push button and defining a height of the push button, the third face connecting the first face and second face.

12. The hearing device according to any of the preceding items, wherein the air gap is provided at the third face of the push button.

13. The hearing device according to any of the preceding items, wherein the first input transducer is provided on the printed circuit board, or wherein the first input transducer is provided in the foam element.

14. The hearing device according to any of the preceding items, wherein the first input transducer has a transducer opening, and wherein a physical filter is arranged at the transducer opening, the physical filter providing an acoustic filtering of the received audio signal.

15. The hearing device according to any of the preceding items, wherein the push button and/or the foam element is/are configured to be detached from the housing of the hearing device and be replaced with a new corresponding push button and/or foam element.

LIST OF REFERENCES

2 hearing device
4 housing
6 first input transducer
8 push button
10 foam element
12 first foam part
14 first surface of the housing
16 exterior of the housing
18 air gap
20 opening in the housing
22 dome
24 interior space/cavity of housing
26 printed circuit board (PCB)
28 electrical contact
28' extra electrical contact
30 protrusion of push button
32 cut-out in foam element
33 first face of push button
34 second face of push button
35 third face of push button
36 second foam part
38 hole in PCB for first input transducer
38' hole in PCB for other input transducer

The invention claimed is:

1. A hearing device comprising a housing, wherein the housing comprises:

a first input transducer configured to generate one or more input transducer signals based on a received audio signal;

a push button for controlling one or more functionalities of the hearing device; and a foam element arranged at least partly between the first input transducer and the push button for supporting the push button, wherein the foam element comprises a first foam part, the first foam part being an open-cell foam configured to block ear wax and/or dirt.

2. The hearing device according to claim 1, wherein the housing has a surface with an opening, at least a part of the push button located in the opening of the surface, the surface facing towards a surrounding when the hearing device is worn by a user of the hearing device.

3. The hearing device according to claim 1, further comprising an air gap between the push button and the housing.

4. The hearing device according to claim 1, further comprising a printed circuit board (PCB), and wherein the printed circuit board has an electrical contact to provide an electrical connection for controlling the one or more functionalities of the hearing device in response to an actuation of the push button.

5. The hearing device according to claim 4, wherein the foam element at least partly encases or encloses or surrounds the electrical contact.

6. The hearing device according to claim 1, wherein the housing comprises an opening, and wherein at least a part of the push button is in the opening.

7. The hearing device according to claim 1, wherein the housing comprises a surface having an opening, and wherein the foam element has a width that is longer than a cross-sectional dimension of the opening.

8. The hearing device according to claim 1, wherein the foam element comprises an opening or a recess for accommodating an electrical contact.

9. The hearing device according to claim 1, wherein the foam element has an uniform thickness.

10. The hearing device according to claim 1, further comprises an electrical contact, wherein a first part of the foam element above the electrical contact has a thickness that is smaller than a thickness of a second part of the foam element.

11. The hearing device according to claim 1, wherein the foam element further comprises a second foam part, wherein the second foam part is along an edge of the foam element, and wherein the first foam part is in a centre of the foam element.

12. The hearing device according to claim 11, wherein the second foam part is a closed-cell foam.

13. The hearing device according to claim 1, wherein the push button and/or the foam element is/are removeable from the housing of the hearing device.

14. The hearing device according to claim 13, further comprising a replacement push button for replacing the push button.

15. The hearing device according to claim 13, further comprising a replacement foam element for replacing the foam element.

* * * * *